US011866936B2

(12) United States Patent
Anshin

(10) Patent No.: US 11,866,936 B2
(45) Date of Patent: Jan. 9, 2024

(54) FOLDABLE ROOF

(71) Applicant: Yaacov Yehiel Anshin, Beit Shemesh (IL)

(72) Inventor: Yaacov Yehiel Anshin, Beit Shemesh (IL)

( * ) Notice: Subject to any disclaimer, the term of this patent is extended or adjusted under 35 U.S.C. 154(b) by 0 days.

(21) Appl. No.: 17/705,335

(22) Filed: Mar. 27, 2022

(65) Prior Publication Data

US 2022/0403651 A1 Dec. 22, 2022

(30) Foreign Application Priority Data

Jun. 17, 2021 (IL) ..... 284149

(51) Int. Cl.
*E04B 7/16* (2006.01)

(52) U.S. Cl.
CPC ..... *E04B 7/166* (2013.01)

(58) Field of Classification Search
CPC .. E04B 7/16; E04B 7/163; E04B 7/166; E04F 10/10
See application file for complete search history.

(56) References Cited

U.S. PATENT DOCUMENTS 1,251,499 A * 1/1918 Gampp ..... E04F 10/10 160/222
2,291,714 A * 8/1942 Heiser ..... E04F 10/10 49/77.1
2,581,827 A * 1/1952 Zveibil ..... E04F 10/10 160/901
5,306,210 A * 4/1994 Smit ..... F24F 13/15 52/473
9,175,511 B2 * 11/2015 Whytlaw ..... E04F 10/10
9,422,715 B1 * 8/2016 Selzer ..... E04D 11/00
10,988,936 B2 * 4/2021 Soetanto ..... E06B 7/082
2009/0050280 A1 * 2/2009 Morris ..... A47H 1/04 160/345
2015/0052815 A1 * 2/2015 Arteta Loredo ..... E06B 9/0638 49/81.1
2020/0354961 A1 * 11/2020 Soetanto ..... E06B 7/082
2021/0355685 A1 * 11/2021 Terenzi ..... E04F 10/10

* cited by examiner

*Primary Examiner* — Christine T Cajilig
(74) *Attorney, Agent, or Firm* — Mark M. Friedman

(57) ABSTRACT

A foldable roof, including a plurality of elongated plates, for being disposed one aside the other, and a plurality of supporting members each for supporting one of the elongated plates, where each two adjacent supporting members of the supporting members are pivotally connected to one another, thereby allowing deploying and folding the elongated plates, and for each of the plates and its supporting member, gravity disposition elements configured to allow perpendicular displacement between the plate and the supporting member while limiting parallel displacement therebetween, thereby at any state of the foldable roof except for a folded state, each plate is connected to the supporting member thereof by gravity only.

4 Claims, 5 Drawing Sheets

FOLDABLE ROOF

CROSS-REFERENCE TO RELATED APPLICATIONS

This application claims the benefit of priority from Israel Patent Application No. 284149, filed Jun. 17, 2021, the disclosure of which is incorporated herein by reference.

TECHNICAL FIELD

The invention relates to the field of Jewish Sukkah.

BACKGROUND

Jewish Sukkah constitutes a living room including walls and roof, the roof requires shadowing by thin wooden pieces which are not fixed to a metal structure.

There is a long felt need to provide a convenient deployment and gathering of these wooden pieces.

SUMMARY

A foldable roof, including
plates;
supporting members, pivotally connected to one another; and
gravity disposition elements.

BRIEF DESCRIPTION OF THE DRAWINGS

Embodiments, features, and aspects of the invention are described herein in conjunction with the following drawings in which.

The drawings are not necessarily drawn to scale.

DETAILED DESCRIPTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
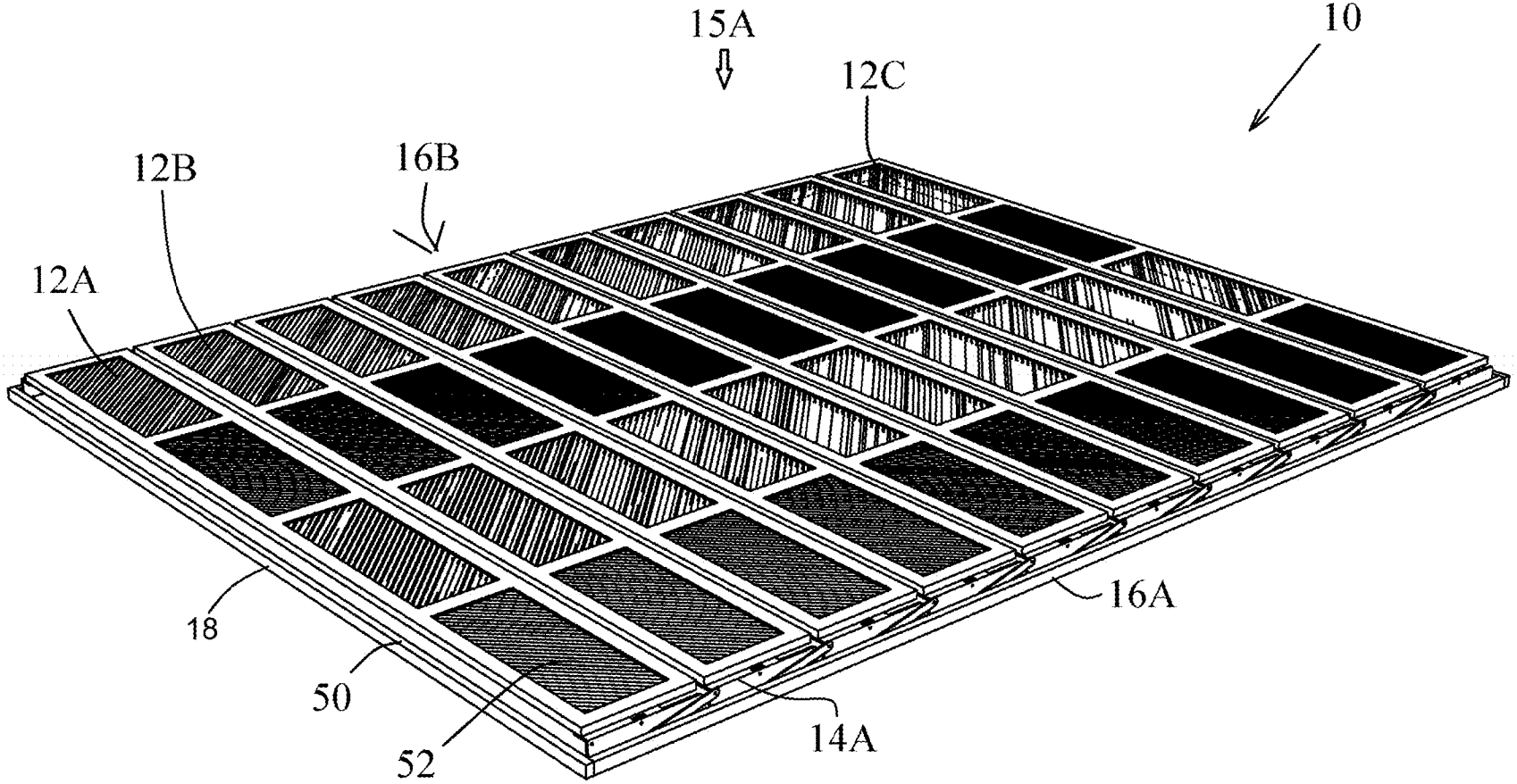
FIG. 1 depicts a foldable roof according to one embodiment, at the deployed state.

FIG. 1 depicts a foldable roof according to one embodiment, at the deployed state.

A foldable roof 10 according to one embodiment, includes a plurality of plates 12A, 12B, etc., each including a wood frame 50 binding a plurality of bamboo or other wood rods 52, thus being Kosher for a roof of a Sukkah according to Jewish law. Frame 50 need not include all of the drawn four bars.

Each of plates 12A, 12B, etc. is supported at non-folded state 15A by a foldable support 14. Foldable support 14 is slidable and foldable in relation to parallel rails 16A and 16B, forming a structure 18 together with other bars.

Figure 2:
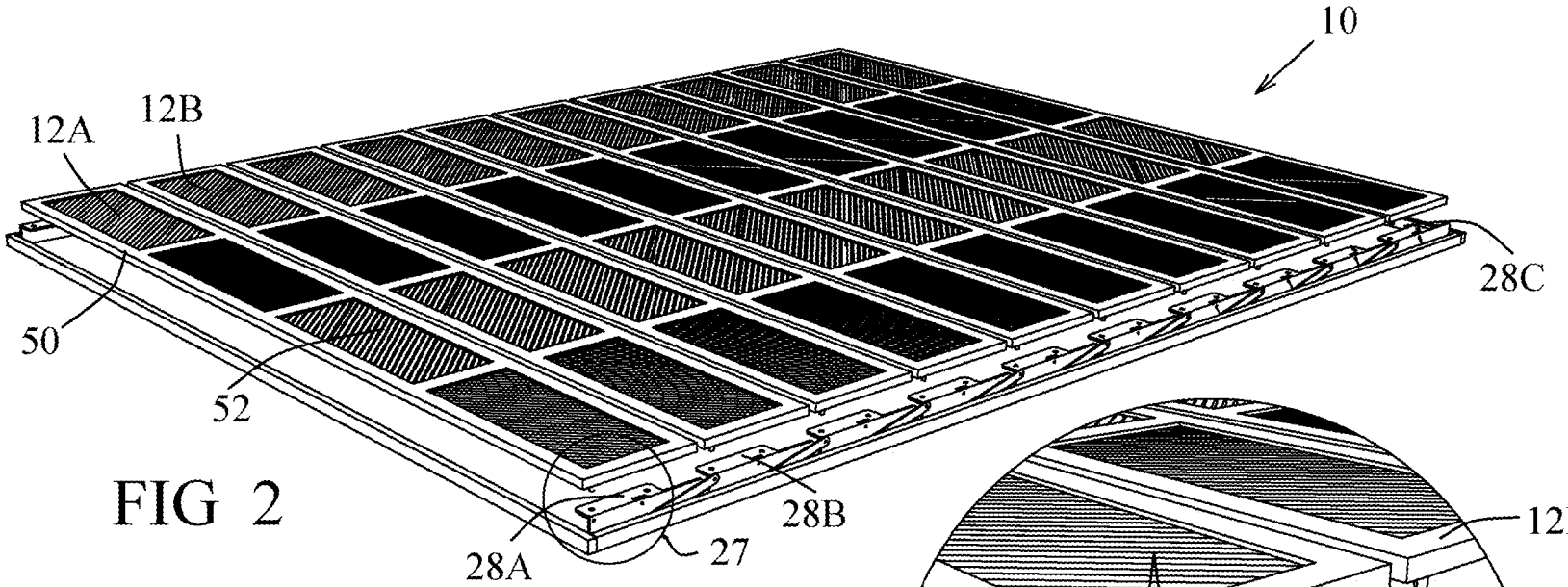
FIG. 2 depicts the foldable roof at the deployed state of FIG. 1 showing the plates disposed separated above the foldable support.

FIG. 2 depicts the foldable roof at the deployed state of FIG. 1 showing the plates disposed separated above the foldable support.

Plates 12A, 12B, etc. and support 14 are configured not to be fixed to one another, but rather to lay plates 12A, 12B, etc. horizontally on support 14, thus the connection therebetween at the non-folded state is not by fixing, but rather relies on gravity only. This since fixing of wood rods 52 to a metal structure, such as to support 14 being of metal, is forbidden by Jewish law of Sukkah.

Figure 3:
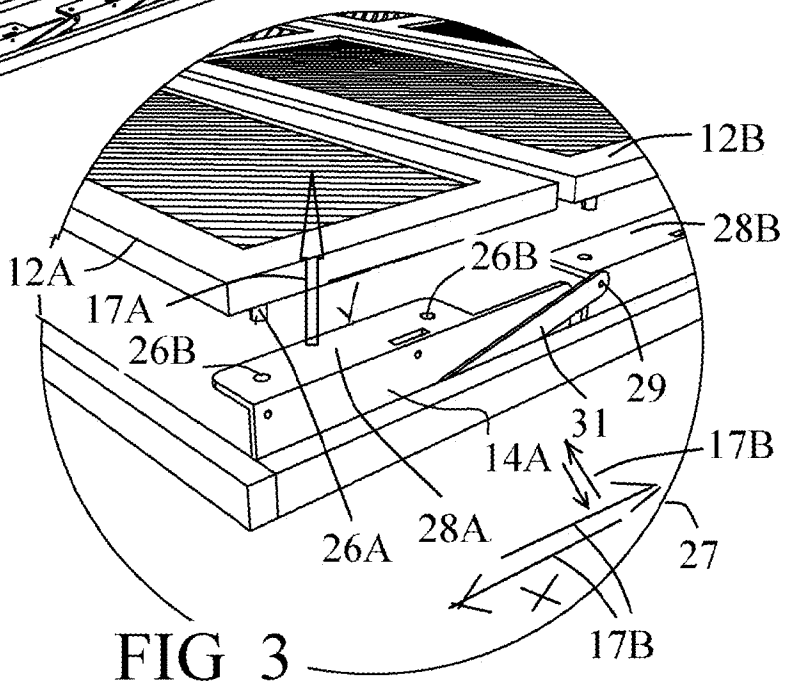
FIG. 3 is a magnification of a portion of FIG. 3.

FIG. 3 is a magnification of a portion of FIG. 3.

Support 14 includes a plurality of supporting members 28A, 28B, etc. being pivotally connected to one another via pivots 29. Each plate is supported at the non-folded state by one supporting member, thus plate 12A is supported by supporting member 28A, plate 12B is supported by supporting member 28B, etc.

Plate 12A and its supporting member 28A include gravity disposition elements 26A and 26B respectively, configured to allow perpendicular displacement 17A therebetween while not allowing parallel displacement 17B therebetween.

According to one embodiment, disposition element 26A of plate 12A constitutes a protrusion being right angled to plate 12A; and disposition element 26B of supporting member 28A constitutes a hole being fitted to protrusion 26A for housing thereof.

Figure 4:
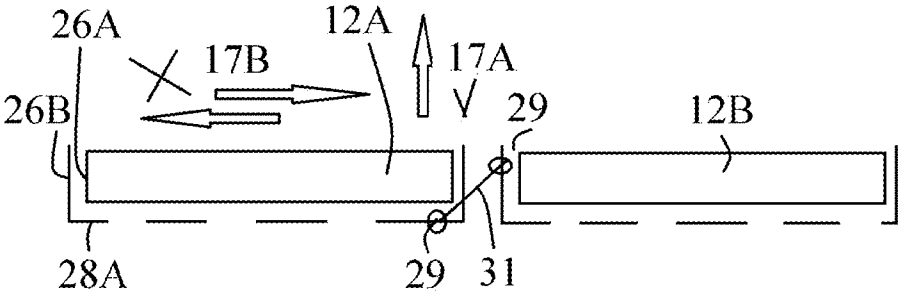
FIG. 4 is a front view of the magnification of FIG. 3 according to another embodiment.

FIG. 4 is a front view of the magnification of FIG. 3 according to another embodiment.

According to another embodiment, disposition element 26A of plate 12A is the thickness of plate 12A; and gravity disposition element 26B of supporting member 28A constitutes vertical walls 26B being fitted to the thickness of plate 12A.

Figure 5:
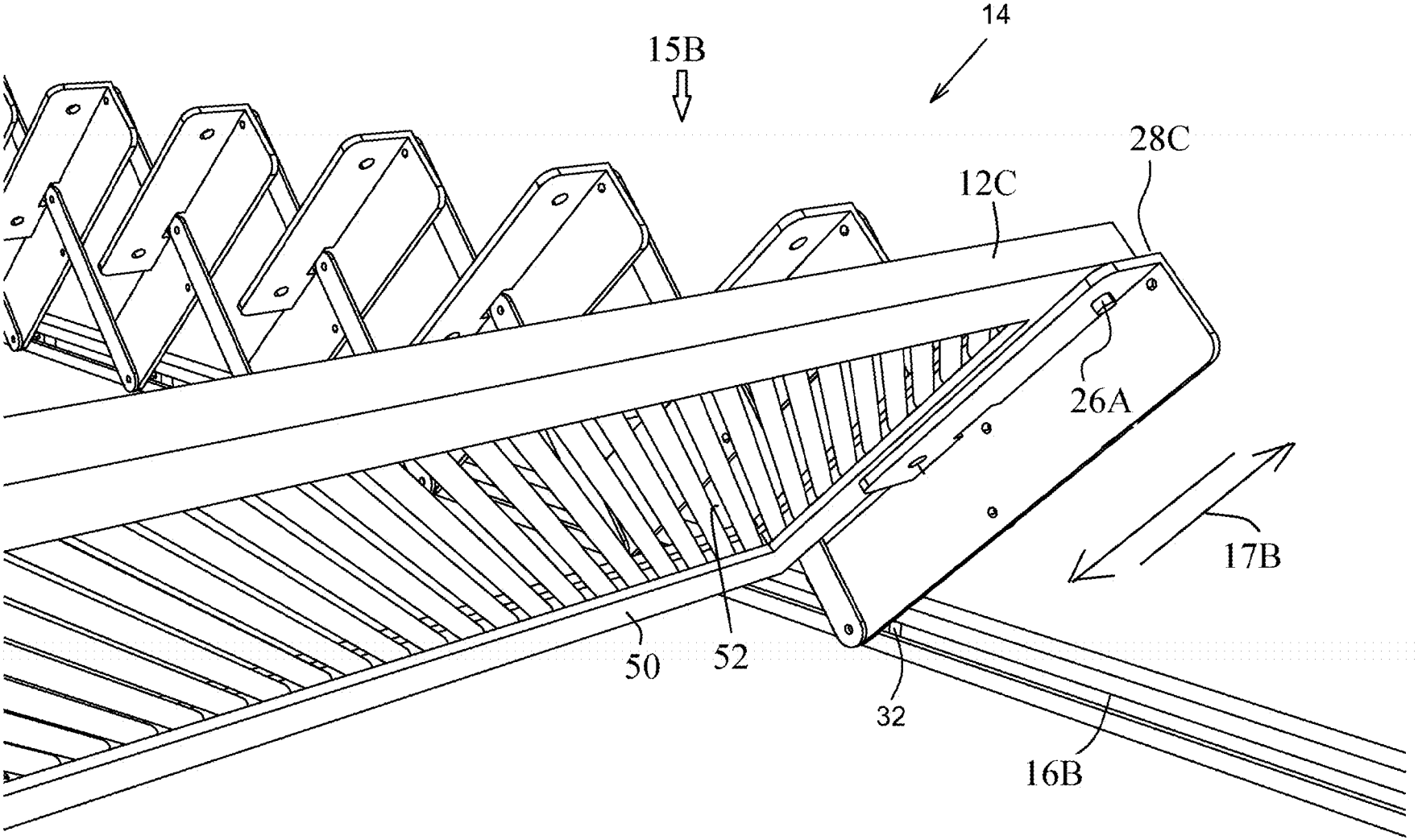
FIG. 5 depicts the foldable roof of FIG. 1 at a semi-folded state, showing only one plate supported.

FIG. 5 depicts the foldable roof of FIG. 1 at a semi-folded state, showing only one plate supported.

At the semi-folded state 15B, disposition elements 28A (not shown) and 28B sufficiently disallow parallel displacement 17B between plate 12A and supporting member 28A even while plate 12A and supporting member 28A are tilted at the semi-folded state.

Figure 6:
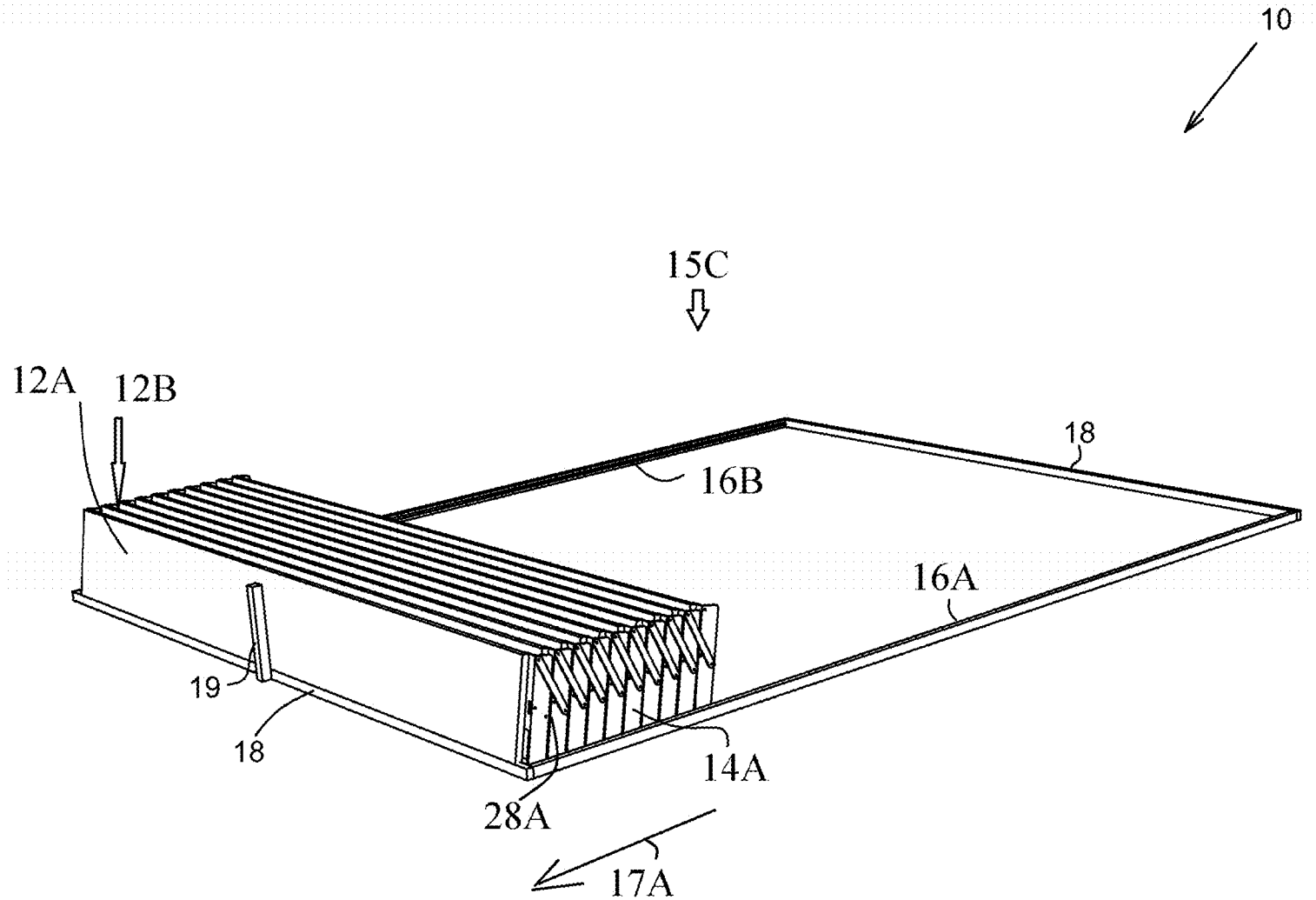
FIG. 6 depicts the foldable roof of FIG. 1 at the folded state.

FIG. 6 depicts the foldable roof of FIG. 1 at the folded state.

At the completely folded state 15C of which plates 12A and 12A are disposed erected and attached to one another, disposition elements 28A and 28B of FIG. 3 allow perpendicular displacement 17A displacement 17B between plate 12A and supporting member 28A, at the folded state of FIG. 5, thus gravity does accompany disposition elements 28A and 28B of FIG. 3 to connect plate 12A to supporting member 28A at the folded state.

This is not problematic since at folded state 15C plate 12A is erected and disposed attached to a barrier 19 extending from structure 18, thus barrier 19 instead of the gravity force presses the last plate 12A towards its supporting member 28A.

Plate 12B as well is erected at folded state 12C and disposed attached to a plate 12A, thus plate 12A presses plate 12B towards its supporting member 28B.

Figure 7:
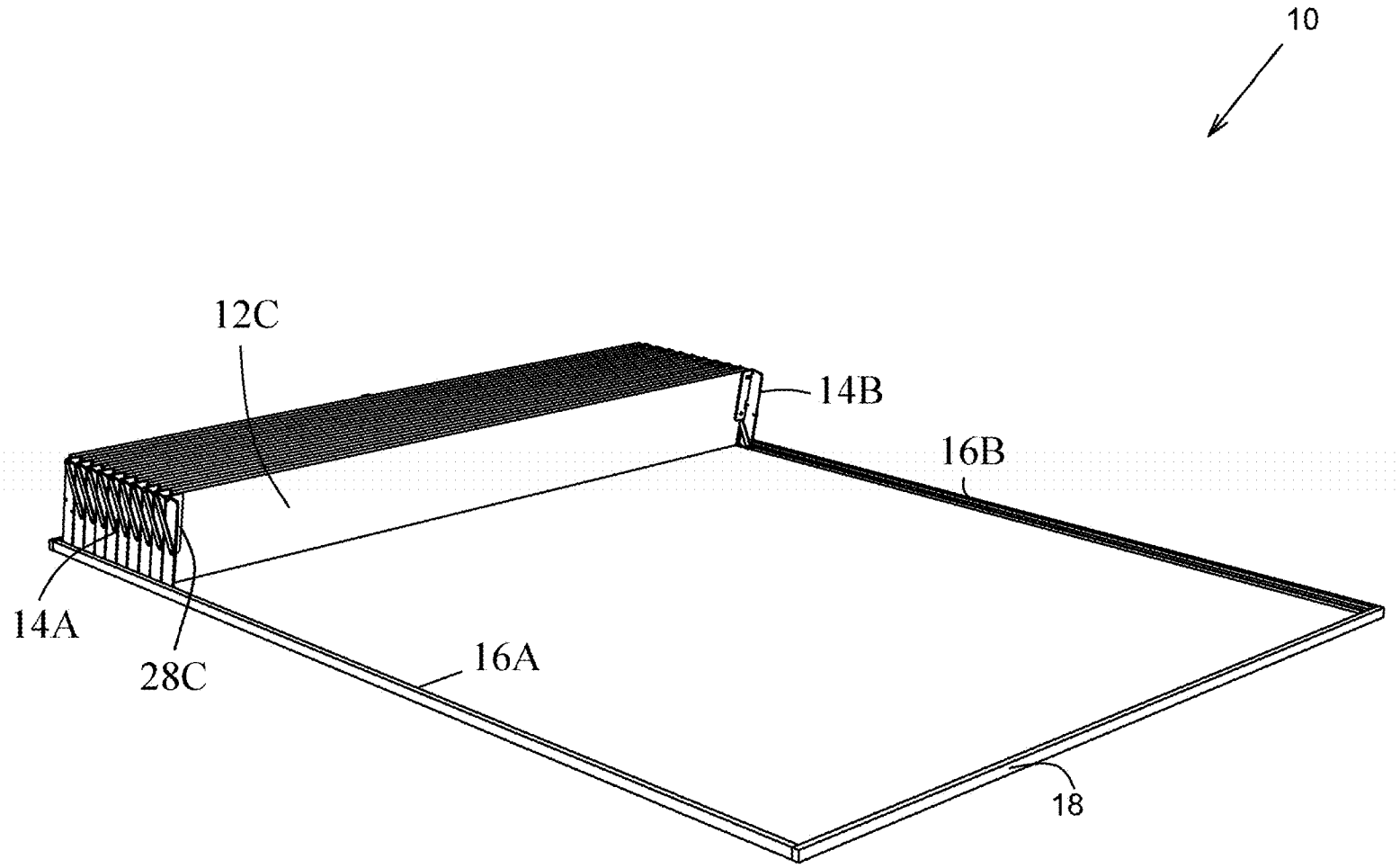
FIG. 7 depicts the folded state of FIG. 5 from the opposite angle of view.

FIG. 7 depicts the folded state of FIG. 5 from the opposite angle of view.

The last plate 12C is pressed by the last supporting member 28C.

Thus, in one aspect, the invention is directed to a foldable roof (10), including:

a plurality of elongated plates (12A,12B), for being disposed one aside the other; and a plurality of supporting members (28A,28B) each for supporting one of the elongated plates (12A,12B), wherein each two adjacent supporting members of the supporting members (28A,28B) are pivotally (29) connected to one another, thereby allowing deploying and folding the elongated plates (12A,12B); and for each of the plates (12A) and its supporting member (28A), gravity disposition elements (26A,26B) configured to allow perpendicular displacement (17A) between the plate (12A) and the supporting member (28A) while limiting parallel displacement (17B) therebetween, thereby at any state (15A,15B) of the foldable roof (10) except for a folded state (15C), each plate (12B) is connected to the supporting member (28B) thereof by gravity only, whereas at the folded state (15C), the plate (12B) is connected to the supporting member (28B) thereof by pressure applied on the plate (12B) by a plate (12A) being adjacent thereto.

Each of the elongated plates (12A,12B) may include:

at least one wood frame (50); and a plurality of wood rods (52) bound by the wood frame (50).

The foldable roof (10) may further include a structure (18) including two rails (16A,16B) for sliding and for folding the supporting members (28A,28B) in relation thereto.

The foldable roof (10) may further include a barrier (19) extending from the structure (18), for pressing a last plate (12A) of the plurality of plates (12A,12B) towards the supporting member (28A) thereof.

In another aspect, the invention is directed to a foldable roof (10), including a plurality of elongated plates (12A, 12B), for being disposed one aside the other horizontally deployed and vertically attached to one another, wherein each of the elongated plates (12A,12B) includes:

at least one wood frame (50); and a plurality of wood rods (52) bound by the frame/s (50).

In the figures and/or description herein, the following reference numerals (Reference Signs List) have been mentioned:

numeral 10 denotes the foldable roof according to one embodiment of the invention;

12A,12B,12C: plates;

14A,14B: foldable supports, each including supporting members 28A,28B, etc.;

15A: non folded state;

15B: semi folded state;

16A: rail for sliding foldable support 14A;

16B: rail for sliding foldable support 14B;

17A: displacement of plate 12A perpendicular to plate 12A;

17B: displacement of plate 12A parallel to plate 12A;

18: structure;

19: barrier;

26A,26B: elements for connecting plate 12A to supporting member 28A by gravity without fixing;

27: zone;

28A,28B,28C: supporting members;

29: pivot;

31: bar for obtaining pivotal connection;

32: cart for sliding supporting member 28A;

50: wood frame;

52: wood rods for shadowing;

The foregoing description and illustrations of the embodiments of the invention have been presented for the purpose of illustration, and are not intended to be exhaustive or to limit the invention to the above description in any form.

Any term that has been defined above and used in the claims, should be interpreted according to this definition.

The reference numbers in the claims are not a part of the claims, but rather used for facilitating the reading thereof. These reference numbers should not be interpreted as limiting the claims in any form.

What is claimed is:

1. A foldable roof, comprising a plurality of supporting members each for supporting one flat, elongated plate, wherein each two adjacent supporting members of said supporting members are pivotally connected to one another, thereby allowing deploying and folding said elongated plates, and wherein each of said supporting members comprises at least one gravity disposition element configured to allow perpendicular displacement between the plate and the supporting member while limiting parallel displacement therebetween, thereby the plate is not fixed to the supporting member but connected to the supporting member thereof by gravity only.

2. A foldable roof, comprising a plurality of supporting members each for supporting one elongated plate, wherein each two adjacent supporting members of said supporting members are pivotally connected to one another, thereby allowing deploying and folding said elongated plates, and wherein each of said supporting members comprises at least one gravity disposition element configured to allow perpendicular displacement between the plate and the supporting member while limiting parallel displacement therebetween, thereby the plate is not fixed to the supporting member, said plates supported by said supporting members, thereby at any state of said plates except for a folded state thereof, each plate is connected to the supporting member thereof by gravity only, whereas at said folded state, a pivotal connection of each of said two adjacent supporting members is configured to connect the plate to the supporting member thereof by pressure applied on the plate by a plate being adjacent thereto.

3. The foldable roof according to claim 2, wherein each of said elongated plates comprises:

at least one wood frame, and a plurality of wood rods bound by said at least one wood frame.

4. A foldable roof, comprising a plurality of supporting members each for supporting one elongated plate, wherein each two adjacent supporting members of said supporting members are pivotally connected to one another, thereby allowing deploying and folding said elongated plates, and wherein each of said supporting members comprises at least one gravity disposition element configured to allow perpendicular displacement between the plate and the supporting member while limiting parallel displacement therebetween, thereby the plate is not fixed to the supporting member, a structure comprising two rails for sliding and for folding said supporting members in relation thereto, and a barrier extending from said structure, for pressing a last plate of said plurality of plates towards the supporting member thereof.

* * * * *